US006998075B2

(12) United States Patent
Sandqvist

(10) Patent No.: US 6,998,075 B2
(45) Date of Patent: Feb. 14, 2006

(54) METHOD FOR CASTING OF CONCRETE PRODUCTS

(75) Inventor: Leo Sandqvist, Forssa (FI)

(73) Assignee: Addtek Research & Development Oy AB, Vantaa (FI)

( * ) Notice: Subject to any disclaimer, the term of this patent is extended or adjusted under 35 U.S.C. 154(b) by 336 days.

(21) Appl. No.: 10/320,454

(22) Filed: Dec. 17, 2002

(65) Prior Publication Data

US 2003/0141608 A1 Jul. 31, 2003

(30) Foreign Application Priority Data

Jan. 30, 2002 (FI) ..... 20020175

(51) Int. Cl.

| | |
|---|---|
| ***B28B 3/22*** | (2006.01) |
| ***B28B 3/24*** | (2006.01) |
| ***B28B 13/00*** | (2006.01) |
| ***B28B 13/02*** | (2006.01) |

(52) U.S. Cl. ..... 264/33; 264/34; 264/40.1; 264/40.4; 264/209.1; 264/211.11; 264/333; 425/62; 425/63; 425/64; 425/145; 425/147; 425/148

(58) Field of Classification Search ..... 264/33, 264/34, 40.1, 40.4, 333, 209.1, 211.11; 425/62, 425/63, 64, 145, 147, 148

See application file for complete search history.

(56) References Cited

U.S. PATENT DOCUMENTS

| | | | | | |
|---|---|---|---|---|---|
| 2,607,579 | A | * | 8/1952 | Noble | 177/249 |
| 3,292,227 | A | * | 12/1966 | Olds | 425/214 |
| 3,429,130 | A | * | 2/1969 | Feiner et al. | 405/116 |
| 3,608,011 | A | * | 9/1971 | Jones | 264/70 |
| 3,623,708 | A | * | 11/1971 | Futty et al. | 366/156.1 |
| 4,073,592 | A | * | 2/1978 | Godberson et al. | 404/82 |
| 4,310,293 | A | * | 1/1982 | Eggleton | 425/62 |
| 4,526,493 | A | * | 7/1985 | Hall et al. | 404/105 |
| 4,773,838 | A | * | 9/1988 | Seppanen | 425/63 |
| 5,023,030 | A | * | 6/1991 | Rantanen | 264/40.5 |
| 5,779,953 | A | | 7/1998 | Harala et al. | |
| 5,879,104 | A | * | 3/1999 | Ulrich | 404/102 |

FOREIGN PATENT DOCUMENTS

| | | | |
|---|---|---|---|
| FI | 102057 | B | 4/1994 |
| FI | 991165 | A | 5/1999 |
| WO | WO 00/71315 | A1 | 11/2000 |
| WO | WO 01/10616 | A1 | 2/2001 |

* cited by examiner

*Primary Examiner*—Michael P. Colaianni
*Assistant Examiner*—Michael Poe
(74) *Attorney, Agent, or Firm*—Buchanan Ingersoll PC

(57) ABSTRACT

A method and apparatus are disclosed for slip-form casting a concrete product, the product being made from at least two different grades of concrete so that the concrete mix grade can be changed in an uninterrupted fashion during casting at a desired point along the length of the casting bed.

8 Claims, 1 Drawing Sheet

METHOD FOR CASTING OF CONCRETE PRODUCTS

This application claims priority under 35 U.S.C. §§ 119 and/or 365 to Patent Application No. 20020175 filed in Finland on Jan. 30, 2002; the entire content of which is hereby incorporated by reference.

FIELD OF THE INVENTION

The present invention relates to a method for fabricating prestressed concrete products by a continuous slip-form casting method, whereby one or more grades of concrete mix is fed onto the casting bed at a constant pressure by means of auger feeders. The invention also relates to a slip-form casting apparatus for fabricating prestressed concrete products, whereby the apparatus comprises a slip-form casting machine which is adapted movable on wheels running along a casting bed, forms a mold in cooperation with side walls and a top plate, has its feed hopper equipped with compartments for feeding concrete mixes of different compositions and includes machinery for feeding a desired type of concrete mix.

BACKGROUND OF THE INVENTION

In a slipforming process, the concrete mix is extruded with the help of auger feeders into a mold or through nozzles, whereby the casting machine is propelled along the casting bed by the reaction forces imposed on the auger feeders. The ready-cast product remains on the casting bed. Conventionally, the entire length of the long casting bed is configured to be cast according to the needs of that individual piece of concrete slab having the most stringent specifications in the casting run. Then, this specific slab dictates the pretensioning steel tendons, their pretension forces and the concrete mix grade to be used in the casting run. Resultingly, an extra high amount of reinforcing steel and concrete mix of an unnecessarily high grade are wasted in many of the other slabs to be cut from the long slab cast on the bed. Such extra costs can be reduced, e.g., by way of using a concrete mix grade adjusted to meet the specifications of each individual slab.

Now the present invention makes it possible to cast concrete products of different quality specifications in a single slip-form casting run by virtue of providing the casting machine with a compartmentalized feed hopper and then controlling the concrete mix feed from the compartments according to the progress of the casting run along the length of the casting bed.

A two-compartment slip-form casting technique known in the art is the so-called slideformer method, wherein two or three layers of concrete are cast sequentially in order to obtain a desired end product. All the concrete layers are fed from different feed hoppers and, generally, all the hoppers are filled with the same concrete mix grade. In exceptional cases, a different concrete grade such as suitable for making exposed aggregate products, for instance, is cast into the bottom layer of the slab or to the surface layer thereof. In the prior-art method, each one of the cast concrete mix layers is compacted separately.

In the method and apparatus described in FI Pat. Appl. No. 991,165 for fabrication of fiber-reinforced concrete products by extruder casting technique, a slip-form casting machine is disclosed having its feed hopper partitioned into at least two compartments and equipped with a control gate adapted to cover the feed opening provided at the bottom of either one of the two feed compartments. In this system, one compartment of the feed hopper contains standard-grade concrete mix, while the other compartment is filled with fiber-reinforced mix. In this fashion, the control gate of the feed hopper can be operated to adjust the feed ratio of the different concrete mixes so as to obtain a desired kind of end product quality. The primary function of this apparatus is to provide a nonhomogeneous distribution of fiber reinforcement in the volume of the end product.

It must be noted that the patent application described above concerns only the feed ratio of the fiber-reinforced mix to the standard-grade concrete mix. The application does not propose the use of plural types of other possible concrete mix grades.

SUMMARY OF THE INVENTION

It is an object of the present invention to provide a novel type of slip-form casting method capable of permitting instantaneous change of the concrete mix grade being cast in a slip-form process thus making it possible to fabricate end products of a desired kind having an optimized concrete grade at different points of the product. In the method according to the invention, the selected grade of concrete mix is fed into the entire cross section of the product as casting proceeds along the casting bed.

The goal of the invention is achieved by virtue of dividing the feed hopper of the casting machine into two or more separate compartments, whereby different concrete mix grades can be metered controlledly from the hopper so as to pass a desired concrete mix grade onto the auger feeders as necessary. The feed hopper may be controlled according to the length of product cast on the bed thus making it possible to feed a desired concrete mix grade over a predetermined length of the casting bed. In this fashion, the controlled operation of the casting machine feed hopper provides uninterrupted feed of concrete mix onto the auger feeders and, in spite of a change in the concrete mix grade, a continuously homogeneous casting result.

Inasmuch as the concrete mix grade may thus be varied as desired, e.g., so that certain ones of individual slabs cut from a long slab may be of a different concrete grade than that of the other slabs. Also the different parts of a given slab may be made from different concrete mix grades, e.g., so that the ends of a given slab are fabricated from a different grade than that used for the middle portion of the slab. Generally, the most commonly used types of concrete mix grades different from the basic grade can be a higher-strength or lower-strength grade, fiber-reinforced or colored concrete or the like.

Among others, the invention offers the following significant benefits:

- use of optimized-grade concrete gives savings in the need for extra amount of cement and admixtures,
- use of a higher-grade or fiber-reinforced type of concrete mix allows additional reinforcing steels otherwise required for a given individual piece of slab to be omitted from the entire length of a raw slab being fabricated on the casting bed,
- balcony slabs can be cast from colored concrete thus making painting unnecessary during building erection, as well as renovation painting, inasmuch as through-colored concrete grade can be used, and
- slabs to be provided with a great number of openings can be made from a special grade concrete to avoid cracks.

Furthermore, if there is a risk of exceeding the shear strength of long or heavily stressed slabs close to their support point, the end portion of the slab can be cast using concrete mix of a higher strength grade or, e.g., by fortifying the supported beam portion with fiber-reinforced concrete, whereby the shear strength of the slab increases thus making it possible to set the load-bearing strength to a value specified for each individual trimmed slab. The shear strength of a slab may also become a limiting factor if slabs are mounted on yielding steel beams, whereby the additional stress due to the lateral bending of the slab reduces the shear load bearing capacity of the slab. Hereby, extra strengthening of the slab end portion can give the slab additional strength so that the slab can take the load imposed thereon.

Such use of higher-strength and fiber-reinforced concrete at the slab end portion removes the need for additional reinforcing steels at the support load bearing area of the slab that in the slip-form casting technology is almost impossible to implement without essentially degrading the efficiency of mass production casting. Now the novel casting technology according to the invention increases the range of slab applications and thus improves the competitive edge of the entire industrial manufacturing branch.

BRIEF DESCRIPTION OF THE DRAWING

Next, the invention will be examined in greater detail by making reference to the attached drawing, wherein.

DETAILED DESCRIPTION OF THE INVENTION

Figure 1:
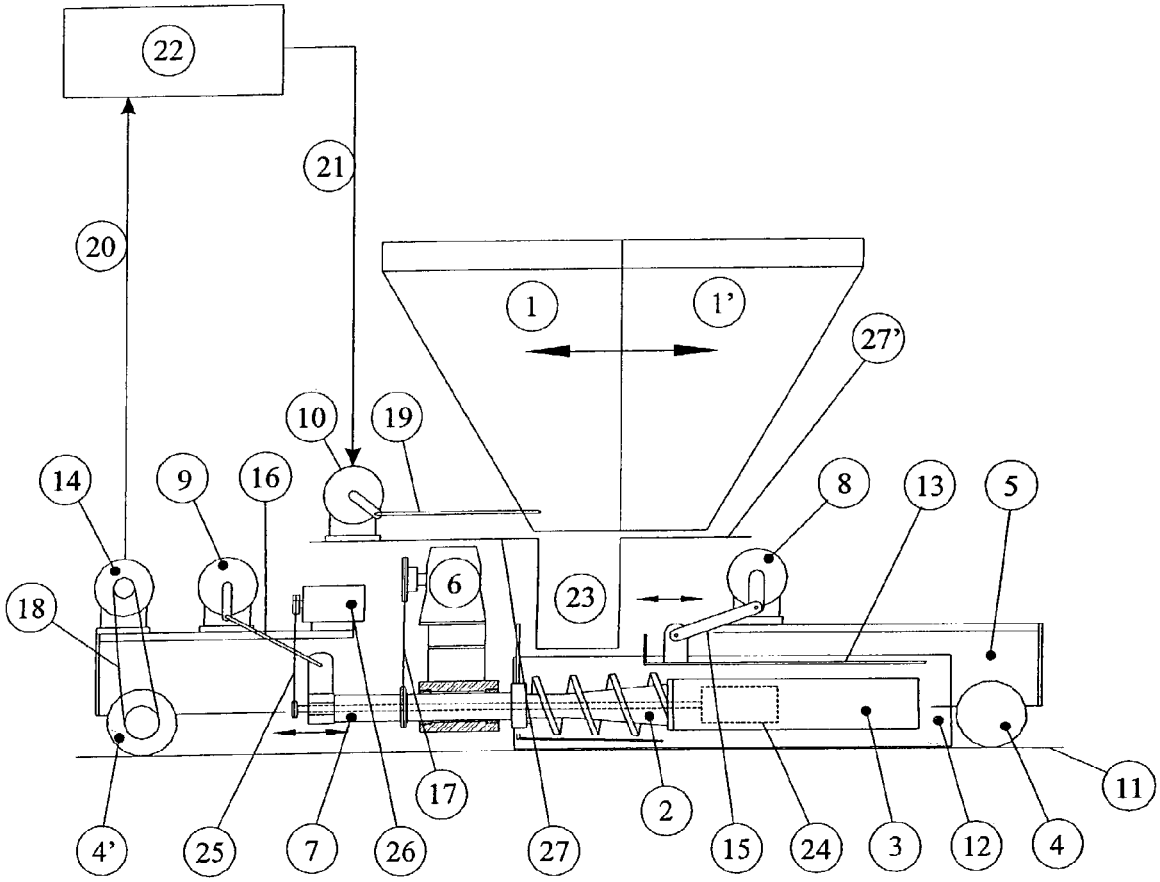
FIG. 1 shows a partially sectional view of a casting apparatus according to the invention.

Referring to FIG. 1, the apparatus according to the invention shown therein is an extruder-type slip-form casting machine adapted to move on support wheels 4, 4' along the side rails of a mold 11. The apparatus is assembled on a framework 5. In the illustrated exemplary embodiment, the casting machine is provided with three conical auger feeders 2. The augers 2 are mounted on the framework 5 so as to be supported by rotary auger drive shafts 7. At the trailing end of the augers 2 in opposite direction relative to the casting travel are adapted core-shaping mandrels 3. The auger drive shafts 7 are connected by a crank mechanism 16 to a drive motor 9 of the compaction system, while the auger drive shaft is connected by a chain transmission 17 to the drive motor 6 of the augers. At the ingoing end of the auger feeders 2, above the machinery, is adapted a conical concrete mix feed hopper partitioned into two compartments 1, 1'. Below the feed hopper is adapted a concrete mix feed box 23 that passes the concrete mix further to the augers 2. Next to the feed box 23 in the opposite direction to the casting travel are located a top troweling beam 13 above the casting machine and side troweling beams 12 at the sides of the machine. The top troweling beam 13 is connected by a crank mechanism 15 to the drive machinery 8 of the top troweling beam. The feed hopper is connected by a crank mechanism 19 to the drive machinery 10 of the feed hopper. The upper part of the feed box 23 is provided with gate plates 27, 27' adapted to close that one of the compartments 1, 1' which is not needed at a given time to feed concrete mix into the feed box 23. With the help of a chain transmission 18, a pulse transducer 14 is connected to one of the support wheels 4' located at the front end of the apparatus frame 5 traveling in the casting direction. From the pulse transducer 14 is passed a pulse signal line 20 to a control unit 22 and therefrom is further taken a control signal line 21 to the feed hopper transfer machinery. For concrete mixes known most difficult to compact, into the interior bore of the core-shaping mandrels 3 are adapted vibrators 24 connected by a belt transmission 25 to a drive motor 26.

In the slip-form casting machine described above, the changeover from one concrete mix to another takes place by way of moving the concrete mix feed hopper relative to the feed box 23. In the situation illustrated in the figure, the concrete mix being cast flows from the first compartment 1 of the feed hopper via its opened bottom opening into the feed box 23 and therefrom further to the augers 2. When the mix to be cast is to be changed, the feed hopper is moved relative to the feed box by means of the feed hopper drive machinery 10 and its crank mechanism 19. Hereby, the movement of the feed hopper causes its opening at the bottom of the first compartment 1 to close and, respectively, the bottom opening of the second compartment 1' to open, whereby the concrete mix contained in the second compartment can pass via the feed box to the augers.

Without departing from the scope and spirit of the invention, the feed hopper can be partitioned into even more compartments, thus allowing a greater number of casting material to be used in the fabrication of a precast product. Furthermore, the feed hopper movements may be contemplated to occur in several directions relative to the feed box.

What is claimed is:

1. A method for fabricating a concrete product in a substantially horizontal slip-form casting process using two or more different grades of concrete mix, in which method concrete mix is fed into a slip-form mold of a defined cross section moving progressively in the casting process so as to give a concrete product a desired shape, whereby two or more different grades of concrete mix can be used in the product cast in accordance with the method wherein the concrete mix grade is changed in an uninterrupted fashion during the casting process in at least one point of the casting run by virtue of moving a concrete mix feed hopper relative to other parts of a slip-form casting apparatus.

2. The method of claim 1, wherein the concrete mix feed hopper is moved in the casting direction.

3. The method of claim 1, wherein the distance already cast is measured and, based on the measured casting distance, the type of concrete mix is changed.

4. The method of claim 3, wherein the concrete mix feed hopper is moved in the casting direction.

5. The method of claim 1, wherein the desired concrete mix grade is cast into the entire cross section of the concrete product.

6. The method of claim 5, wherein the concrete mix feed hopper is moved in the casting direction.

7. The method of claim 5, wherein the distance already cast is measured and, based on the measured casting distance, the type of concrete mix is changed.

8. The method of claim 7, wherein the concrete mix feed hopper is moved in the casting direction.

* * * * *